US007044797B1

(12) United States Patent
Lai

(10) Patent No.: US 7,044,797 B1
(45) Date of Patent: May 16, 2006

(54) MEMORY CARD CONNECTOR

(75) Inventor: Yaw-Huey Lai, Taipei (TW)

(73) Assignee: Taisol Electronics Co., Ltd., Taipei (TW)

( * ) Notice: Subject to any disclaimer, the term of this patent is extended or adjusted under 35 U.S.C. 154(b) by 0 days.

(21) Appl. No.: 10/905,902

(22) Filed: Jan. 26, 2005

(51) Int. Cl.
*H01R 24/00* (2006.01)

(52) U.S. Cl. ..... 439/630

(58) Field of Classification Search ..... 439/630, 439/326, 159
See application file for complete search history.

(56) References Cited

U.S. PATENT DOCUMENTS 6,641,413 B1 * 11/2003 Kuroda ..... 439/159
6,835,100 B1 * 12/2004 Chen ..... 439/630
6,863,571 B1 * 3/2005 Sato et al. ..... 439/630
6,875,057 B1 * 4/2005 Miyazawa et al. ..... 439/630
6,881,086 B1 * 4/2005 Ohashi ..... 439/326
6,896,555 B1 * 5/2005 Su et al. ..... 439/630
2005/0176304 A1 * 8/2005 Yiu ..... 439/630

* cited by examiner

*Primary Examiner*—Tulsidas C. Patel
*Assistant Examiner*—Harshad C Patel

(57) ABSTRACT

A memory card connector includes an electrically insulative housing, which defines a receiving space for receiving different memory cards, a plurality of terminals mounted in inside the receiving space of the electrically insulative housing for the contact of the electric contacts of different memory cards selectively, and a plurality of sliding members arranged one behind another at different elevations inside the receiving space and slidable in direction between the front open side and rear close side of the receiving space and pushable by a respective memory card to have the respective memory card be set into contact with the terminals selectively.

6 Claims, 7 Drawing Sheets

MEMORY CARD CONNECTOR

BACKGROUND OF THE INVENTION

1. Field of the Invention

The present invention relates to a memory card connector and more specifically, to such a memory card connector, which has sliding members arranged one behind another at different elevations for guiding different memory cards into contact with respective terminals and, which automatically ejects the inserted memory card when the user pressed the inserted card.

2. Description of the Related Art

Because of the advantages of strong computing function, fast transmission speed, highly extendibility and high storage density, flash memory has been intensively used in different mobile electronic apparatus to substitute for EEEPROM or battery-operated memory. Following fast development of semiconductor technology, the storage density and transmission speed have been greatly improved. Therefore, advanced flash memory can be used to substitute for diskdrive and other conventional storage media in certain cases. Nowadays, a variety of flash memory devices have been disclosed. These memory devices include typical PCMCIA (Personal Computer Memory Card International Association), MMC (MultiMedia Card), CF (CompactFlash Card), SMC (SmartMedia Card), MS (Memory Stick), SD (SecureDigital Memory Card), XD (xD-Picture Card). These memory cards are well accepted by consumers. Market demand for these memory cards keeps increasing.

Further, a memory card readable electronic apparatus has a memory card connector installed in the circuit board thereof for receiving a memory card. A conventional memory card connector can only accept one particular type of memory card. However, because many different types of memory cards are commercially available, different memory card connectors shall be installed to accept different types of memory cards. It is not economic and requires much installation space when different memory card connectors are used in a circuit board. In order to eliminate these drawbacks, memory card connectors capable of receiving different types of memory cards are developed. A memory card connector capable of receiving different types of memory cards has multiple sets of terminals arranged at different elevations for the contact of different memory cards. Because different memory cards have different dimensions, improper insertion of a memory card may deform or break the terminals, causing the inserted memory card to be stuck in the memory card connector.

Therefore, it is desirable to provide a memory card connector that eliminates the aforesaid drawbacks.

SUMMARY OF THE INVENTION

The present invention has been accomplished under the circumstances in view. It is therefore the main object of the present invention to provide a memory card connector, which prevents contact of the inserted memory card with the terminals for a different type of memory card, thereby prolonging the service life. To achieve this and other objects of the present invention, the memory card connector comprises an electrically insulative housing, which defines a receiving space for receiving different memory cards, a plurality of terminals mounted in inside the receiving space of the electrically insulative housing for the contact of the electric contacts of different memory cards selectively, and a plurality of sliding members arranged one behind another at different elevations inside the receiving space and slidable in direction between the front open side and rear close side of the receiving space and pushable by a respective memory card to have the respective memory card be set into contact with the terminals selectively.

DETAILED DESCRIPTION OF THE PREFERRED EMBODIMENT

Figure 1:
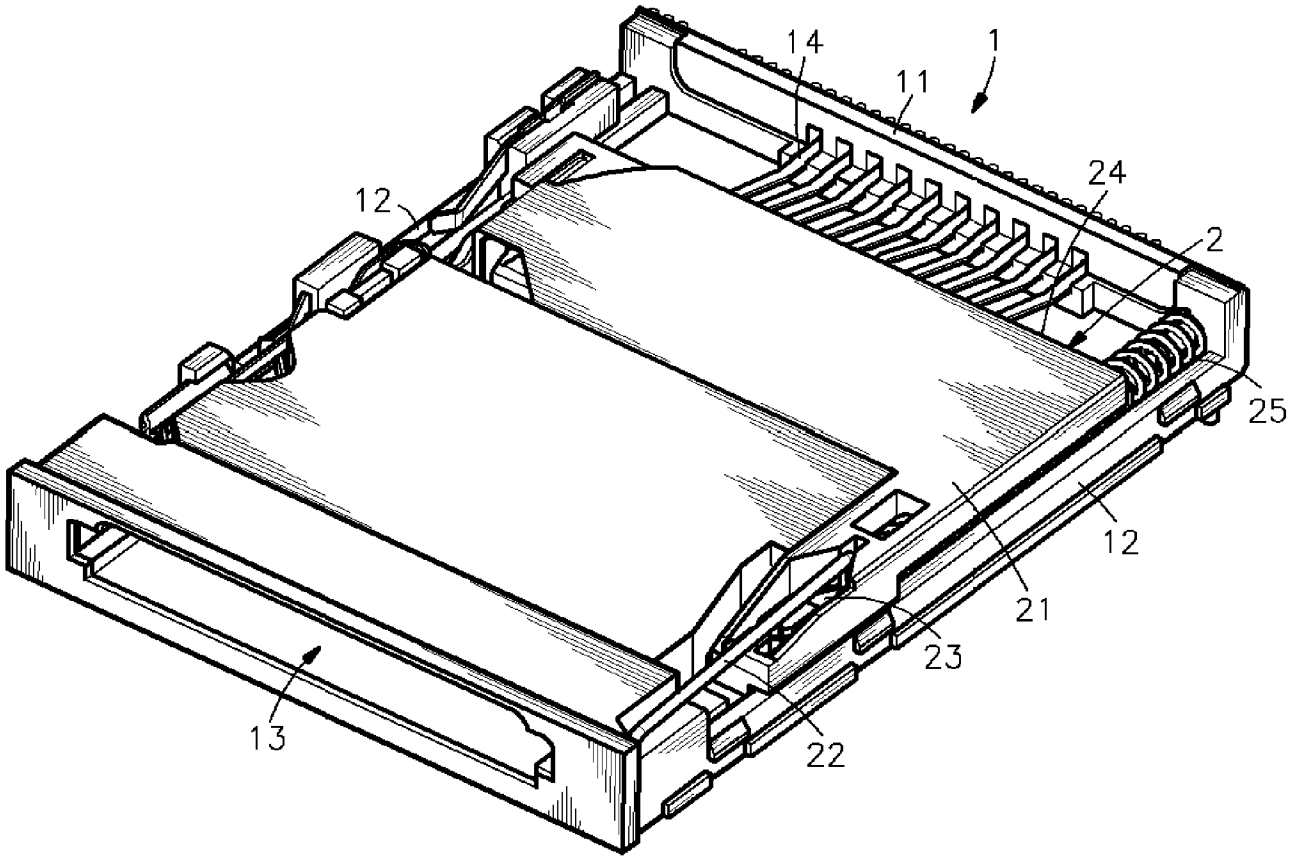
FIG. 1 is a perspective view of a memory card connector according to the present invention.
Figure 2:
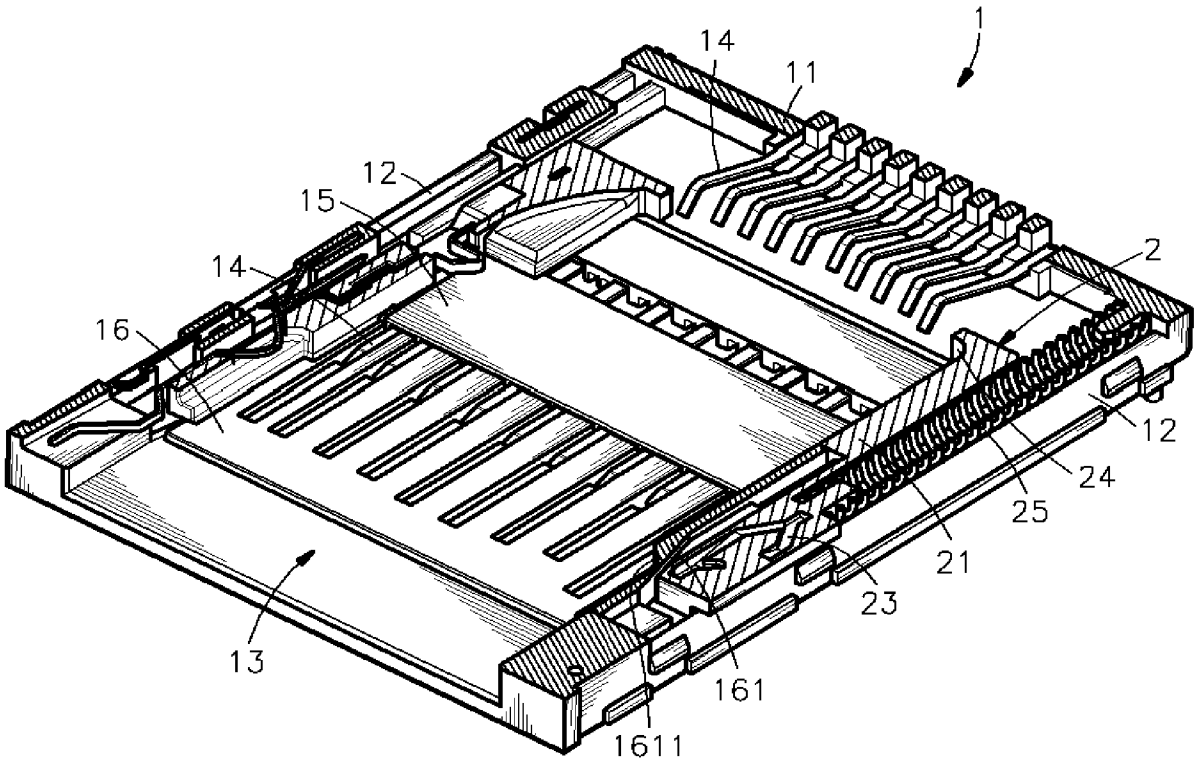
FIG. 2 is a sectional elevation of the memory card connector according to the present invention.
Figure 3:
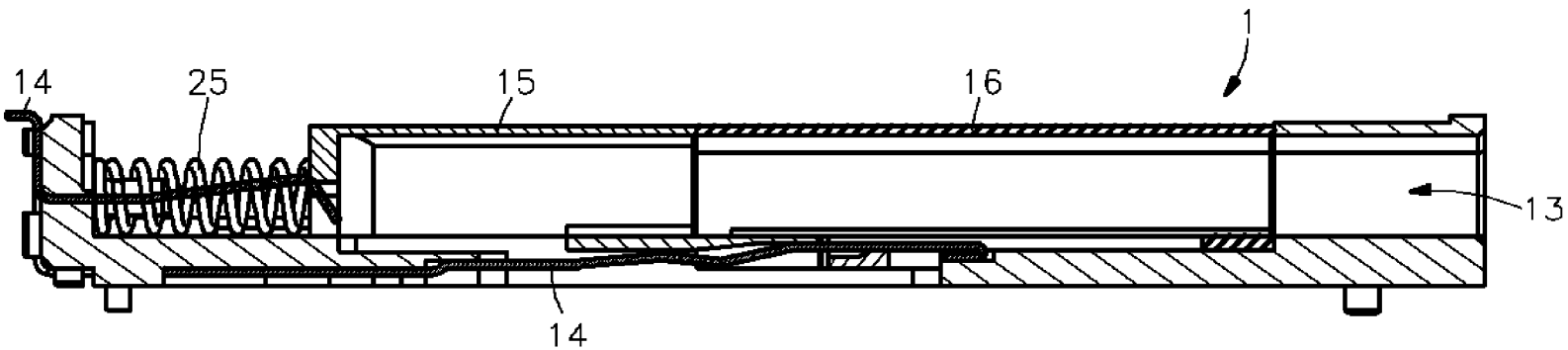
FIG. 3 is a side view in section of the memory card connector according to the present invention.

Referring to FIGS. 1~3, a card connector in accordance with the present invention is shown comprising an electrically insulative housing 1.

The housing 1 comprises a base 11, two side arms 12 respectively extending from the base 11 at two sides in same direction, a receiving space 13 defined between the side arms 12 above the base 11 for receiving one of a variety of memory cards, terminals 14 mounted in the receiving space 13 for the contact of the electric contacts of one of a variety of memory cards insertable into the receiving space 13, a first sliding member 15 mounted in the receiving space 13 and horizontally movable in direction between the front and rear sides of the receiving space 13, and a second sliding member 16 mounted in the receiving space 13 and horizontally movable in direction between the front and rear sides of the receiving space 13. The first sliding member 15 is relatively closer to the rear close side of the receiving space 13. The second sliding member 16 is relatively closer to the front open side of the receiving space 13. The first sliding member 15 is disposed above the elevation of the second sliding member 16. Further, the second sliding member 16 has a push block 161 at one lateral side thereof. The push block 161 has a bearing surface 1611.

A shifting mechanism 2 is installed in the receiving space 13 of the housing 1. The shifting mechanism 2 comprises a base member 21, which defines a circulation groove 23 at one lateral side, a guide rod 22 mounted in the circulation groove 23, a push block 24 spaced behind the circulation groove 23, and a spring member 25 connected between the base member 21 of the shifting mechanism 2 and the base 11 of the housing 1.

Figure 4:
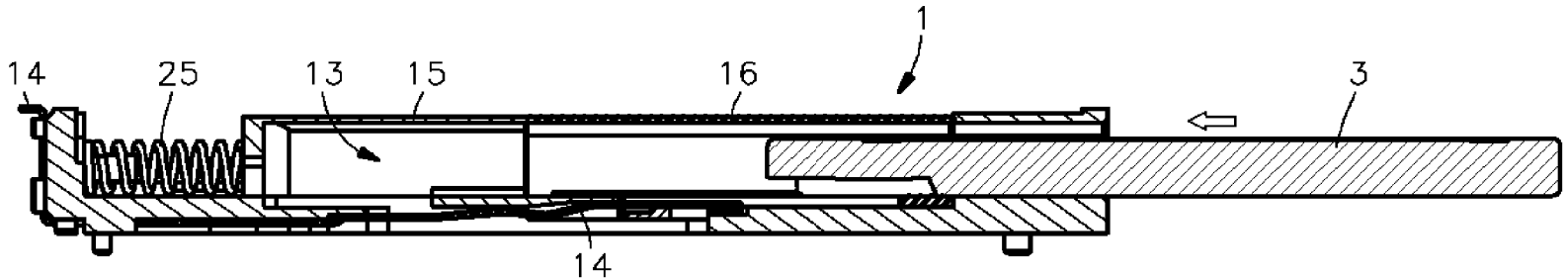
FIG. 4 is a schematic drawing showing insertion of a memory card of first type into the receiving space of the memory card connector according to the present invention.
Figure 5:
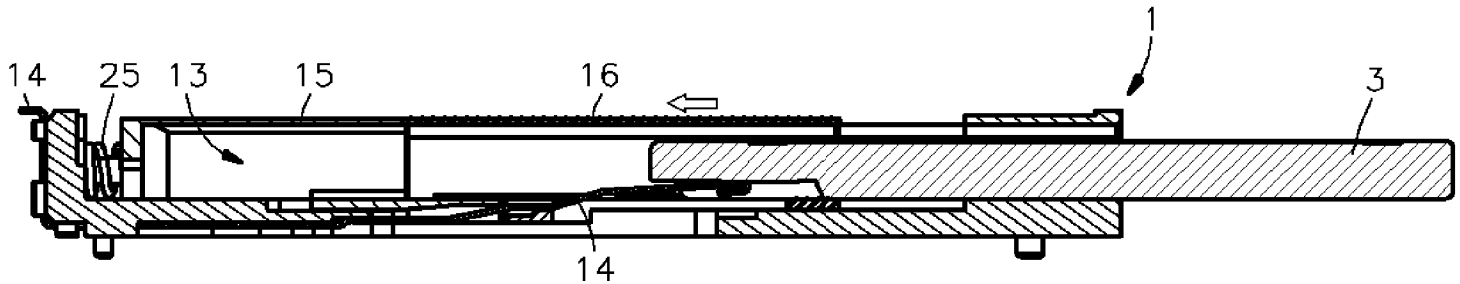
FIG. 5 is similar to FIG. 4 but showing the memory card of first type set into position and kept in contact with the respective terminals in the receiving space of the housing.

Referring to FIGS. 4 and 5 and FIG. 2 again, when inserting a memory card 3 of a first type, for example, SecureDigital Memory Card or MultiMedia Card into the receiving space 13, the front edge of the memory card 3 will touch the bearing surface 1611 of the push block 161 of the second sliding member 16 at first and will then push the second sliding member 16 backwards toward the rear side of the housing 1, thereby causing the push block 161 of the second sliding member 16 to move the shifting mechanism 2 backwards. After the memory card 3 has been set into position with the respective electric contacts thereof kept in contact with the respective terminals 14, the guide rod 22 is positioned in one end of the circulation groove 23, and the spring member 25 is compressed. When wishing to eject the memory card 3, press the memory card 3 to disengage the guide rod 22 from the locking position. At this time, the spring member 25 immediately returns to its former shape to push the shifting mechanism 2 forwards toward the front open side of the receiving space 13 of the housing 1, thereby causing the shifting mechanism 2 to return the first sliding member 15 and the second sliding member 16 to their former positions and to further carry the memory card 3 out of the front open side of the receiving space 13 of the housing 1. At this time, the user can take the memory card 3 away from the housing 1. If the user presses the memory card 3 again, the memory card 3 will be inserted into the inside of the receiving space 13 and locked in position again.

Figure 6:
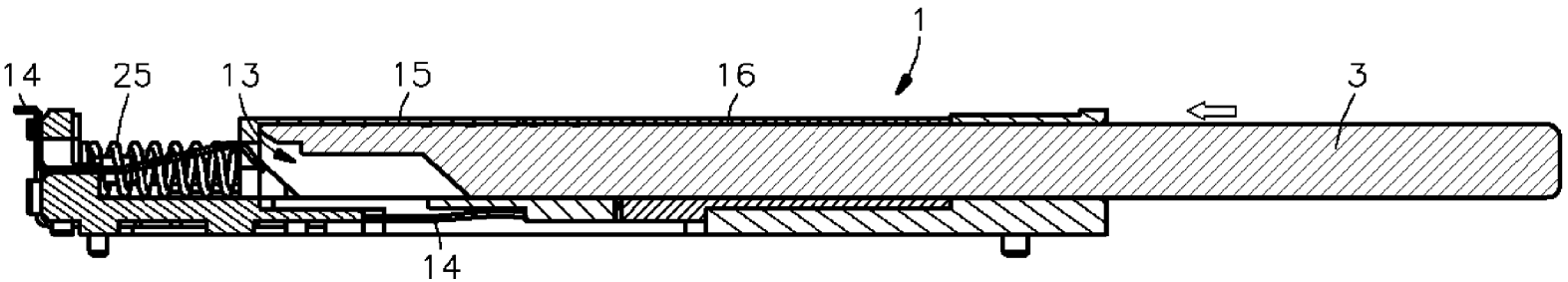
FIG. 6 is a schematic drawing showing insertion of a memory card of second type into the receiving space of the memory card connector according to the present invention.
Figure 7:
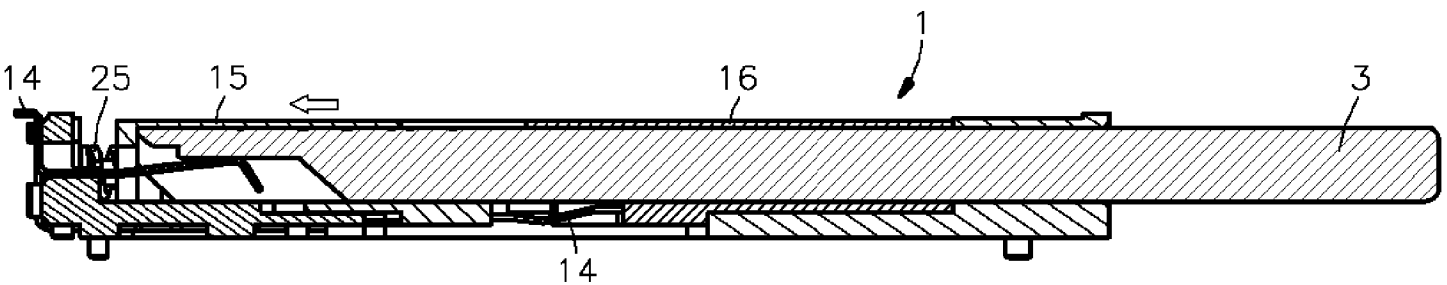
FIG. 7 is similar to FIG. 6 but showing the memory card of second type set into position and kept in contact with the respective terminals in the receiving space of the housing.

Referring to FIGS. 6 and 7 and FIG. 2 again, when inserting a memory card 3 of second type, for example, Memory Stick Card into the receiving space 13 after removal of the aforesaid first type memory card, the memory card 3 will pass over the second sliding member 16 to push the first sliding member 15 and the push block 24 of the shifting mechanism 2 toward the rear side of the housing 1. After the memory card 3 has been set into position with the respective electric contacts thereof kept in contact with the respective terminals 14, the guide rod 22 is positioned in one end of the circulation groove 23, and the spring member 25 is compressed. When wishing to eject the memory card 3, press the memory card 3 to disengage the guide rod 22 from the locking position. At this time, the spring member 25 immediately returns to its former shape to push the shifting mechanism 2 forwards toward the front open side of the receiving space 13 of the housing 1, thereby causing the shifting mechanism 2 to return the first sliding member 15 and to further carry the memory card 3 out of the front open side of the receiving space 13 of the housing 1. This design prevents friction of the inserted memory card against the vacant terminals 14. Further, because the first and second sliding members 15, 16 are designed to have same amount of displacement, the spring member 25 will not be excessively compressed to accelerate the elastic fatigue.

Figure 8:
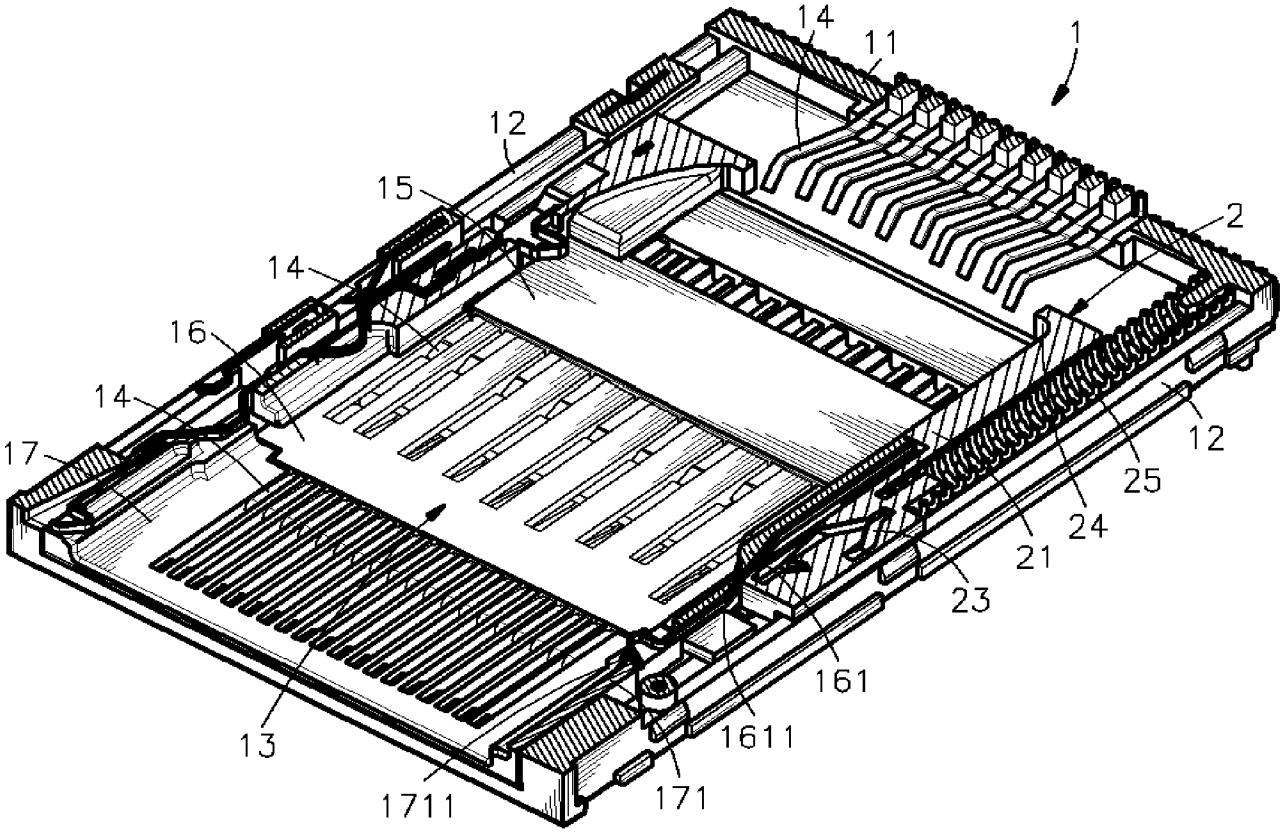
FIG. 8 is a sectional elevation of an alternate form of the memory card connector according to the present invention.

FIG. 8 shows an alternate form of the present invention. According to this embodiment, a third sliding member 17 is mounted inside the housing 1 in front and below the elevation of the second sliding member 16. The third sliding member 17 comprises a push block 171 stopped against the push block 161 of the second sliding member 16. The push block 171 of the third sliding member 17 has a bearing surface 1711.

Figure 9:
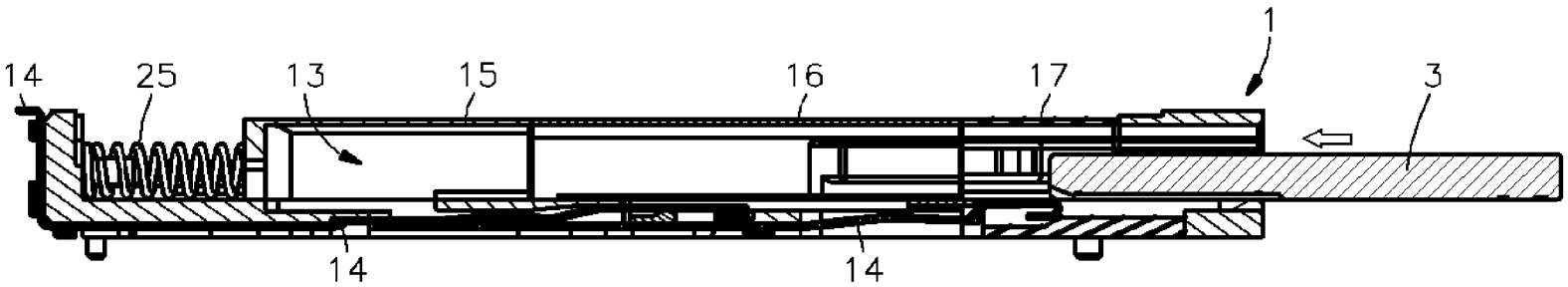
FIG. 9 is a schematic drawing showing insertion of a memory card of third type into the receiving space of the memory card connector according to the present invention.
Figure 10:
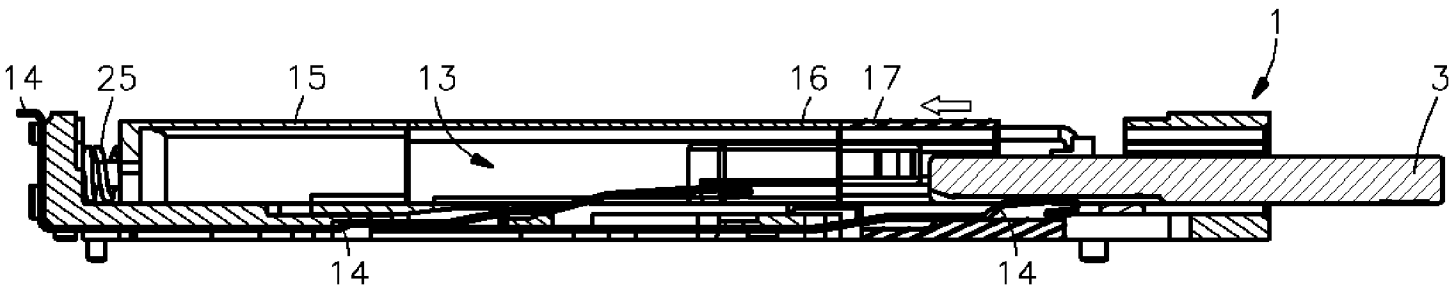
FIG. 10 is similar to FIG. 9 but showing the memory card of third type set into position and kept in contact with the respective terminals in the receiving space of the housing.

Referring to FIGS. 9 and 10 and FIG. 8 again, when inserting a memory card 3 of third type, for example, xD-Picture Card into the receiving space 13, the front edge of the memory card 3 will touch the bearing surface 1711 of the push block 171 of the third sliding member 17 at first and will then push the third sliding member 17 backwards toward the rear side of the housing 1, thereby causing the push block 171 of the third sliding member 17 to move the second sliding member 16 and the first sliding member 15 and further to push the shifting mechanism 2 backwards. After the memory card 3 has been set into position with the respective electric contacts thereof kept in contact with the respective terminals 14, the guide rod 22 is positioned in one end of the circulation groove 23, and the spring member 25 is compressed. When wishing to eject the memory card 3, press the memory card 3 to disengage the guide rod 22 from the locking position. At this time, the spring member 25 immediately returns to its former shape to push the shifting mechanism 2 forwards toward the front open side of the receiving space 13 of the housing 1, thereby causing the shifting mechanism 2 to return the first sliding member 15 and the second sliding member 16 and the third sliding member 17 to their former positions and to further carry the memory card 3 out of the front open side of the receiving space 13 of the housing 1. If the user inserts a memory card 3 of second type into the receiving space 13 after removal of the memory card of third type from the housing 1, the memory card 3 will pass over the third sliding member 17 to push the second sliding member 16 backwards toward the rear side of the receiving space 13. If the user inserts a memory card 3 of first type into the receiving space 13, the memory card 3 will pass over the third sliding member 17 and the second sliding member 16 to push the first sliding member 15 backwards toward the rear side of the receiving space 13. After the memory card 3 has been set into position with the respective electric contacts thereof kept in contact with the respective terminals 14, the guide rod 22 is positioned in one end of the circulation groove 23, and the spring member 25 is compressed.

As indicated above, the memory card connector can be designed to have more than two sliding members to fit more than two different types of memory cards. However, the length of the housing must be relatively increased when increasing the number of sliding members to fit many types of memory cards.

Further, the shifting mechanism 2 is designed to have the guide rod 22 movable in the circulation groove 23 through a cycle and positioned in one end of the circulation groove 23. The locking and unlocking of the guide rod 22 in the circulation groove 23 are of the known art and not within the scope of the present invention, no further detailed description in this regard is necessary.

Therefore, the main feature of the present invention is to have a plurality of sliding members slidably arranged inside the receiving space 13 with one above and behind another to fit different types of memory cards. This design allows one memory card 3 to contact the respective terminals 14 without touching the other terminals. Further, upon insertion of any of a variety of memory cards into the memory card connector, the spring member 25 receives same amount of compressive force, i.e., the spring member 25 will not be excessively compressed to accelerate the elastic fatigue. Further, the receiving space 13 of the housing 1 can receive memory cards of different types at a time. The memory card connector can be designed to receive memory cards of different types such as MMC (MultiMedia Card), CF (CompactFlash Card), SMC (SmartMedia Card), MS (Memory Stick Card), SD (SecureDigital Memory Card), and XD (xD-Picture Card).

A prototype of memory card connector has been constructed with the features of FIGS. 1~10. The memory card connector functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A memory card connector comprising an electrically insulative housing, said electrically insulative housing comprising a base, two side arms arranged in parallel at two opposite lateral sides of said base and a receiving space defined between said side arms above said base for receiving different memory cards, said receiving space having a front open side and a rear close side, and a plurality of terminals mounted in said base inside said receiving space of said electrically insulative housing for the contact of the electric contacts of different memory cards selectively, wherein a first sliding member and a second sliding member are arranged inside said receiving space and slidable in direction between the front open side and rear close side of said receiving space for guiding different types of memory cards into contact with said terminals selectively, said first sliding member being disposed above and behind said second sliding member such that when a first type of memory card is inserted into said receiving space, the inserted first type of memory card pushes said second sliding member and then said first sliding member backwards and is then set into contact with respective terminals in said receiving space, wherein at least one third sliding member mounted inside said receiving space at different elevations is disposed below said second sliding member and directly movable by a respective type of memory card; when a second type of memory card is inserted into said receiving space, the inserted second type of memory card passes over said second sliding member to directly push said first sliding member backwards and is then set into contact with respective terminals in said receiving space.

2. The memory card connector as claimed in claim 1, wherein said second sliding member comprises a push block disposed at one side for pushing said first sliding member, said push block having a bearing surface for pushing by a memory card.

3. The memory card connector as claimed in claim 1, further comprising a shifting mechanism mounted in said receiving space inside said electrically insulative housing and movable with said first sliding member and adapted to lock/return said first sliding member, said shifting mechanism comprising a base member, which defines a circulation groove at one lateral side, a guide rod adapted to be moved in said circulation groove and positioned in one end of said circulation groove, a push block spaced behind said circulation groove, and a spring member connected between the base member of said shifting mechanism and the base of said housing.

4. A memory card connector comprising an electrically insulative housing, said electrically insulative housing comprising a base, two side arms arranged in parallel at two opposite lateral sides of said base, and a receiving space defined between said side arms above said base for receiving different memory cards, said receiving space having a front open side and a rear close side, and a plurality of terminals mounted in said base inside said receiving space of said electrically insulative housing for the contact of the electric contacts of different memory cards selectively, wherein a plurality of sliding members are arranged one behind another at different elevations inside said receiving space and slidable in direction between the front open side and rear close side of said receiving space and pushable by a respective memory card to have the respective memory card be set into contact with said terminals selectively, wherein least one of the sliding members mounted inside said receiving space at different elevations is disposed below another sliding member and directly movable by a respective type of memory card.

5. The memory card connector as claimed in claim 4, wherein said sliding members each have a push block, the push block of an anterior one of said sliding members being stopped at a posterior one of said sliding members.

6. The memory card connector as claimed in claim 4, further comprising a shifting mechanism mounted in said receiving space inside said electrically insulative housing and movable with one said sliding member, said shifting mechanism comprising a base member, which defines a circulation groove at one lateral side, a guide rod adapted to be moved in said circulation groove and positioned in one end of said circulation groove, a push block spaced behind said circulation groove, and a spring member connected between the base member of said shifting mechanism and the base of said housing.

* * * * *